United States Patent [19]

Hume

[11] Patent Number: 4,854,721

[45] Date of Patent: Aug. 8, 1989

[54] BLENDING AND DISPENSING BEVERAGES

[75] Inventor: Ronald W. Hume, Tierra Verde, Fla.

[73] Assignee: Equip-Mark, Inc., Clearwater, Fla.

[21] Appl. No.: 843,784

[22] Filed: Mar. 25, 1986

[51] Int. Cl.[4] ..... B01F 5/06

[52] U.S. Cl. ..... 366/340

[58] Field of Search ..... 366/336, 337, 338, 340, 366/130, 176, 316

[56] References Cited

U.S. PATENT DOCUMENTS

| | | | |
|---|---|---|---|
| 1,924,080 | 8/1933 | Gram | 366/176 X |
| 2,532,973 | 12/1950 | Wallentin et al. | 366/340 X |
| 3,284,055 | 11/1966 | Johansen | 366/316 |
| 4,124,309 | 11/1978 | Yao | 366/340 |
| 4,316,673 | 2/1982 | Speer | 366/340 X |
| 4,441,823 | 4/1984 | Power | 366/340 X |

FOREIGN PATENT DOCUMENTS

| | | | |
|---|---|---|---|
| 2430487 | 8/1975 | Fed. Rep. of Germany | 366/340 |
| 1532742 | 7/1968 | France | 366/340 |
| 52-50062 | 4/1977 | Japan | 366/337 |
| 312168 | 2/1956 | Switzerland | 366/340 |

*Primary Examiner*—Philip R. Coe
*Assistant Examiner*—Scott J. Haugland

[57] ABSTRACT

Apparatus for blending and dispensing liquids, e.g., beverage concentrate and water, using cylinders and pistons, the apparatus including magnetic position sensors to terminate piston strokes, a mixing chamber including repeated flow restrictions and flow diverters, a beverage concentrate bag having an engageable structure at its top and a drainage portion at its bottom, a two-piece fitting for connecting the concentrate bag to a supply line to a cylinder, a bag support structure movable between an operational position in which the bag is suspended and a loading position in which the bag is supported along its side, a multiple piece piston rod threadedly connecting a piston between rod pieces, and a symmetrical arrangement of ports and an annular groove to symmetrically distribute liquid between a cylinder end wall and a piston against it.

15 Claims, 7 Drawing Sheets

FIG 14
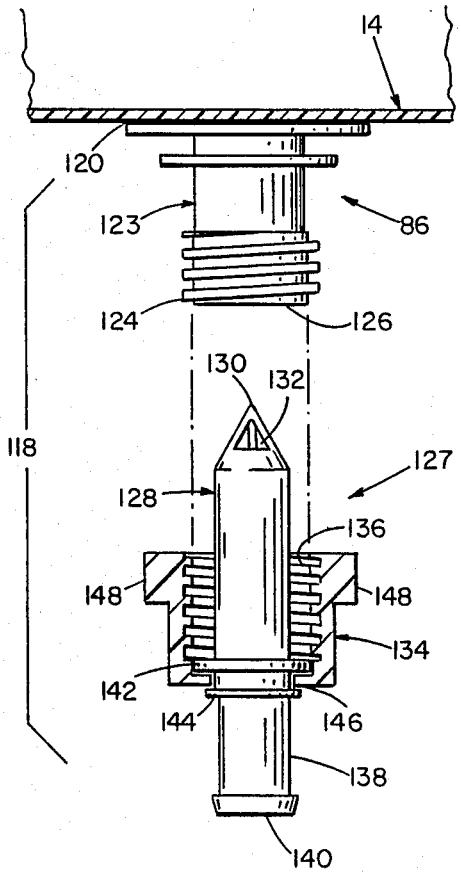
FIG 15
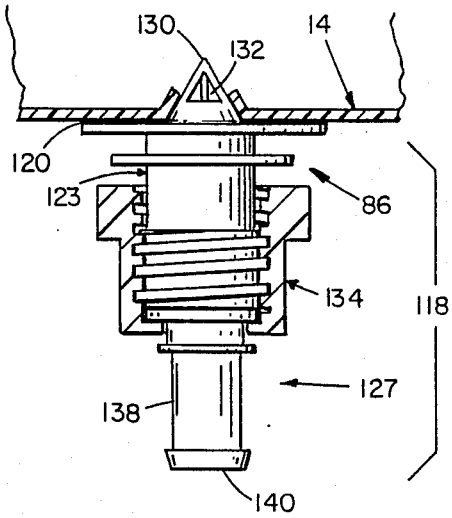
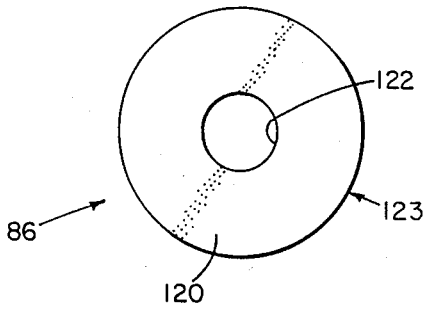
FIG 14A

BLENDING AND DISPENSING BEVERAGES

BACKGROUND OF THE INVENTION

The invention relates to blending and dispensing beverages, e.g., fruit juice reconstituted from concentrate.

Beverages dispensed in commercial establishments are often blended from water and a syrup or concentrate at the time of dispensing into a single serving container for the customer. In a widely used machine, solenoid valves controlling flow of pressurized liquids in different supply lines are operated for predetermined periods of time in order to provide predetermined amounts of the liquids to be blended.

In my U.S. Pat. No. 4,391,291 there is disclosed apparatus for mixing orange juice concentrate and water including two cylinders with pistons, one for metering the water and another for metering the concentrate. The concentrate is supplied from a hopper, and the metered concentrate and water are both supplied to and mixed in a second hopper.

SUMMARY OF THE INVENTION

In one aspect, the invention in general features apparatus for accurately dispensing liquid including a cylinder with a piston operable to discharge a specified volume of liquid during a stroke, a magnet connected for travel with the piston during the stroke, the magnet providing a magnetic field that travels with it, a magnetic position sensor for sensing the magnetic field and providing a signal that is related in magnitude to the strength of the magnetic field, and means for very accurately and repeatedly terminating the stroke when the magnitude of the signal corresponds to a position of the piston corresponding to the desired specified volume.

In preferred embodiments, there are two magnetic position sensors mounted at different positions with respect to the path of travel of the magnet, the different positions corresponding to different volumes; the magnet is mounted on the end of a rod that is connected for sliding with the piston and extends from the cylinder, and the sensors are mounted spaced from and adjacent to different positions along the path of travel of the magnet; one or the other sensor is selected to terminate the stroke by selection switches corresponding to different desired volumes; there are a first solenoid valve controlling flow to one end of the cylinder and a second solenoid valve connected to the other end, the first solenoid valve connecting the one end to a source of pressurized liquid when it receives a driving voltage, the second solenoid valve connecting the other end to the source of pressurized liquid in the absence of the driving voltage; the magnet is adjustably mounted on the rod to adjust its position along the axis with respect to the piston; there are flip-flops connected to be activated by selection switches and reset by sensors; and the flip-flops are connected to provide an activation signal to a driver for the solenoids to provide a driving voltage when a selection switch is activated and to discontinue the activation signal to the driver when the flip-flop is reset.

In another aspect, the invention features apparatus for mixing two liquids in desired proportion including first and second cylinders with reciprocating pistons operable to respectively pump proportionate amounts of the first and second liquids during forward and backward strokes of the pistons, mixing means for mixing the first and second liquids provided from the first and second cylinders and providing the mixed liquids to an outlet, piston direction means for causing the pistons to change between the forward strokes and backward strokes, a magnet connected for reciprocating travel with a piston and to provide a magnetic field that travels with the magnet, and a magnetic position sensor for sensing the position of the magnet and providing a control signal to the piston direction means when the magnet has reached a predetermined position to cause the pistons to reverse direction.

In another aspect, the invention in general features apparatus for thoroughly mixing liquids including a housing defining an inlet and an outlet and a flow path therethrough, a plurality of flow restrictions provided along the flow path to repeatedly provide increased velocity to the liquid, and a plurality of flow diverters after respective flow restrictions to divert the flow of liquid directed to them at increased velocity from the restrictions.

In preferred embodiments, the diverters are diverter plates positioned between flow restrictions so that the liquid leaving one restriction is caused to travel along one surface of a diverter plate to the edge of the diverter plate and to reverse direction and flow along the other surface to the next flow restriction; the flow restrictions are provided by restriction plates having apertures through them; the housing includes a removable cover to the chamber, permitting access to the stacked plurality of diverter and restriction plates connected together for easy removal from the chamber; the diverter plates have edges that are spaced inward from the housing surface defining the chamber, and the restriction plates extend to the housing surface; there are spacers between the plates; the chamber is cylindrical, the plates are circular, and the spacers are provided along the central axis of the chamber; there are plural restrictions symmetrically positioned on a restriction plate; the flow restrictions have elongated flow passages along restriction axes transverse to the direction of flow through them, to provide a velocity increasing restriction, owing to small width and restricted overall flow area, and to provide ability to pass fibrous particles in the liquid, owing to the lengths along the restriction axes; and the elongated flow passages are approximately $\frac{1}{8}$" wide.

In another aspect, the invention features thoroughly and uniformly reconstituting fruit juice including fibrous pulp by adding water to juice concentrate to form a combined stream, and repeatedly subjecting the combined stream to flow restrictions providing an increased velocity and flow diverters diverting liquid subjected to them at increased velocity by the flow restrictions.

In another aspect, the invention features a convenient, easy to store, transport and use beverage concentrate package including a flexible bag with an engageable structure permitting it to be engaged at its top so as to be suspended from a support and a drainage portion at its bottom, and a beverage concentrate inside the bag.

In preferred embodiments, the bottom of the bag slopes at both sides to the drainage portion to assist in draining concentrate; the bag has a front wall and a back wall made of either two pieces of plastic seamed around their peripheries or a single piece of plastic secured at the sides and top; and the bag has a first fitting piece at the drainage portion for connection to a mating second fitting piece of a concentrate supply line.

In another aspect, the invention features a container for a beverage concentrate including a flexible bag having a horizontal tunnel at its top for receiving a horizontal support rod to support the bag along its width and a drainage portion at its bottom.

In another aspect, the invention in general features a two-piece fitting for sealably connecting a supply line to a package of a flexible bag containing a liquid. The first piece has a sealing surface surrounding an entrance to a first flow passage for sealably connecting the first piece to the bag and a discharge end for discharge of liquid from the flow passage. The second piece sealably engages the first piece around the discharge end and provides a second flow passage to a supply end of the second piece for connection to the supply line, the second piece having a piercing member that is movable through the first flow passage and beyond the annular sealing surface to pierce the bag.

In preferred embodiments, the piercing member is movable through the first flow passage by a helical camming member; the piercing member is on an end of a flow tube having the supply end at its other end; the camming member is on a cap surrounding the flow tube and having a hole through which the flow tube passes; the first piece has external threads at the discharge end, and the cap has internal threads that mate with the external threads; the flow tube has an external, annular tube lip, the top of the tube lip bearing against the lower surface of the discharge end; the cap has a lower annular cap lip that bears against the tube lip; and the flow tube has a retaining lip spaced from the tube lip and retaining the cap lip between it and the tube lip.

In another aspect, the invention in general features bag supporting apparatus including a bag suspending member for engaging the top of a flexible bag and suspending the bag when in an operational position, and a bag loading support member connected to the suspending member for supporting the side of the bag in a loading position, leaving the top of the bag free to be easily attached to or disconnected from the suspending member.

In preferred embodiments, the support member is mounted for movement between a generally horizontal orientation, when in the loading position, and a generally vertical orientation, when in the operational position; the support member is mounted for rotation between the loading position and the operational position, the suspending member being attached for rotation with the support member, the suspending member engaging the top of the bag being spaced horizontally from at least part of the support member when in the operational position; the suspending member includes a horizontal rod sized to fit within a tunnel at the top of the bag, and there are a pair of rod supporting brackets extending from the support member; the brackets include slots for receiving portions of the rod, the slots being directed upward at an angle in both the operational and loading positions, to prevent the rod from rolling out of the slots; the support member either includes a refrigerated cabinet door that rotates open about a horizontal axis or includes a horizontal base member adapted to be mounted in a refrigerated cabinet having a door that rotates open about a vertical axis; the base member includes a stop that prevents rotation of the support member beyond a 45° angle with the vertical when in the operational position; there is a bottom support for the bottom of the bag when in the operational position; the bottom support includes two sloping surfaces to direct liquid in the bag to a central drainage region; and the bottom support has two horizontal surfaces at the ends of the sloping surfaces, the horizontal surfaces having ends spaced from each other on opposite sides of a supply tube connection region.

In another aspect, the invention features apparatus for supplying liquid including a flexible bag containing the liquid and having an engageable structure at its top and a drainage portion at its bottom, a bag suspending member for engaging the top of the flexible bag and suspending the bag when in an operational position, and a bag loading support member connected to the suspending member for supporting the side of the bag in a loading position, leaving the top of the bag free to be easily attached to or disconnected from the suspending member.

In another aspect, the invention in general features apparatus for dispensing liquid including a first cylinder, a first piston mounted for sliding in the cylinder, and first and second piston rod pieces that threadedly connect the first piston between them to facilitate assembly or replacement of the piston and cylinder.

In preferred embodiments, the first and second piston rod pieces extend from opposite ends of the first cylinder; there are a third piston rod extending from the other end of the second cylinder and a second piston threadedly connected between the second and third piston rod pieces; and the piston rod pieces are threadedly connected to each other, and the pistons are engaged between opposing surfaces on the piston rod pieces.

In another aspect, the invention in general features apparatus for dispensing liquid including a cylinder having a port for providing pressurized liquid to the end of a variable volume chamber therein, and a piston slidably mounted in the variable volume chamber for movement along a piston axis, including movement to a position against the end and away from a position against the end, the cylinder and the piston providing the liquid symmetrically about the piston axis during movement of the piston near the end, to avoid unbalanced application of forces.

In preferred embodiments, there are plural ports symmetrically positioned about the piston axis; and either the piston has an annular groove in the piston surface facing the end of the cylinder or the end of the cylinder has an annular groove in its surface communicating with the port.

Other advantages and features of the invention will be apparent from the following description of preferred embodiments thereof and from the claims.

DESCRIPTION OF PREFERRED EMBODIMENTS

The drawings will be briefly described first.

Drawings

FIG. 1. is an overall flow diagram showing apparatus for blending and dispensing beverage according to the invention.

FIG. 14 is an exploded elevation, partially in section, of a two-piece fitting for use with the FIG. 12 concentrate bag.

FIG. 14A is a plan view of the bottom piece of the FIG. 14 two-piece fitting.

FIG. 15 is an elevation, partially in section, showing the FIG. 14 fitting in use in communication with the contents of the concentrate bag.

Structure

Figures 1, 2:
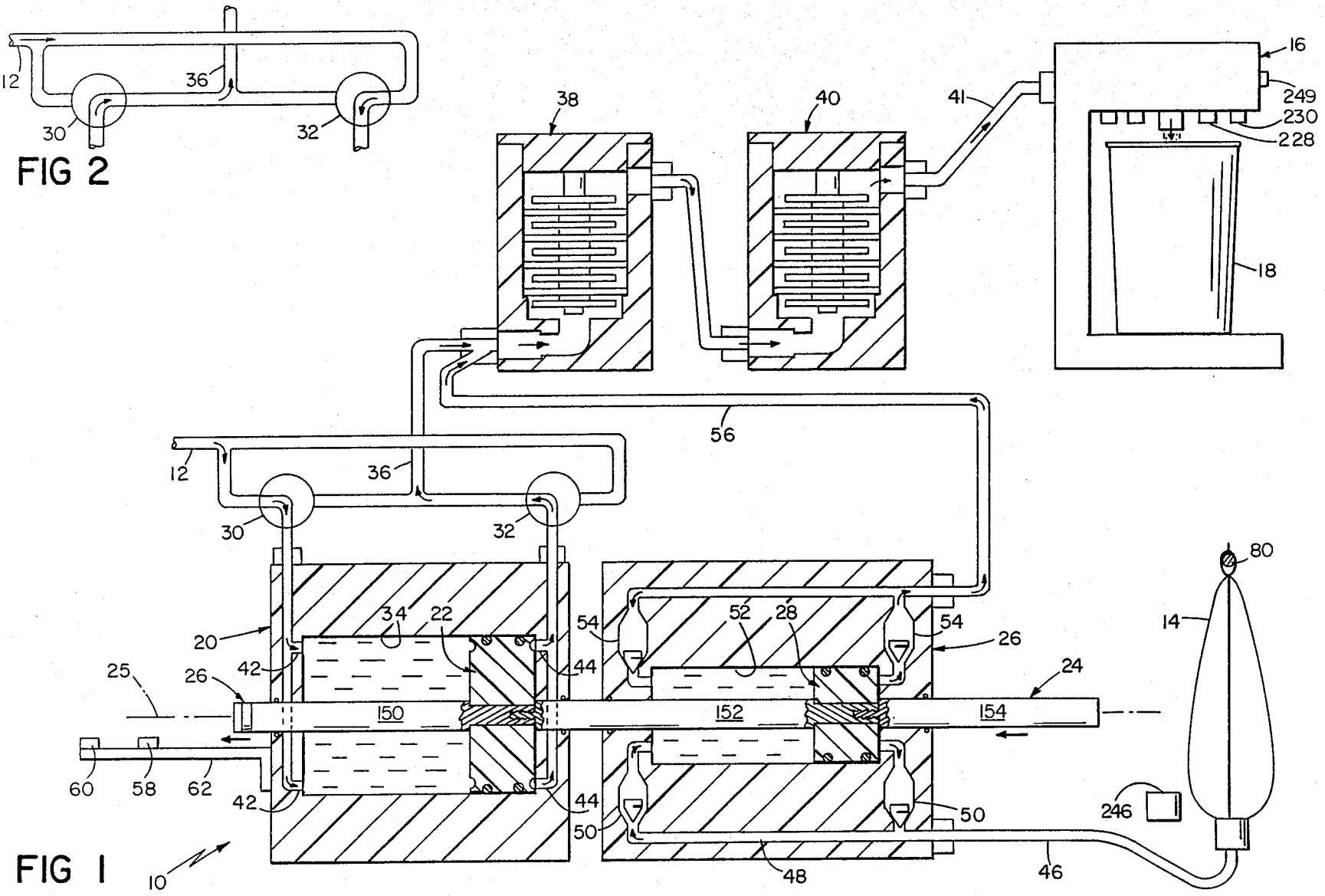
FIG. 2 shows a portion of the FIG. 1 flow diagram with valves in different positions from positions shown in FIG. 1.

Referring to FIGS. 1 and 2, there is shown apparatus 10 for blending water provided under pressure at inlet 12 and orange juice concentrate from bag 14 and for dispensing the resulting reconstituted orange juice at dispenser 16 into an individual serving size (either six ounces or ten ounces) cup 18. Apparatus 10 includes water cylinder 20 having driving water piston 22 slidably mounted therein on piston rod 24 and concentrate cylinder 26 having driven concentrate piston 28 slidably mounted therein, also on piston rod 24. Cylinders 20, 26, shown diagrammatically as being made of a single piece of material, in fact are made of plural pieces assembled together. The area of the face of water piston 22 is five times that of concentrate piston 28, to provide five times as much water as concentrate.

Two-position solenoid valves 30, 32 are switchable between the positions shown diagrammatically in FIGS. 1 and 2 to alternately supply liquid under pressure from inlet 12 to the left side (FIG. 1) of piston 22 in chamber 34 and then the right side (FIG. 2), and to simultaneously alternately permit flow of water to supply tube 36 from the right side (FIG. 1) of piston 22 and then the left side (FIG. 2). Water flowing between valves 30, 32 and chamber 34 enters and leaves the respective ends of chamber 34 via two ports 42 and two ports 44, symmetrically positioned with respect to axis 25 of piston rod 24. Supply tube 36 is connected to first and second mixing chambers 38, 40.

Orange juice concentrate is conveyed through reinforced concentrate supply line 46 to concentrate cylinder 26. Supply line 46 is connected to inlet passage 48 communicating with gravity return one-way valves 50, permitting flow into but not out of chamber 52 of concentrate cylinder 26. Gravity return one-way valves 54 similarly permit flow out of chamber 52 but not into chamber 52. Flow out of cylinder 26 is via concentrate line 56 to mixing chamber 38.

Piston rod 24 extends from the ends of cylinders 20, 26. On the left-hand end of piston rod 24 is magnet 26, which travels along axis 25 above six-ounce and ten-ounce hall effect magnetic position sensors 58, 60 supported by printed circuit board 62 on the side of water cylinder 20. Magnetic position sensors 58, 60 are used to switch solenoid valves 30, 32 from the FIG. 2 positions to the FIG. 1 positions, causing reversal of travel of pistons 22, 28 at the ends of their forward strokes after a volume of liquid equal to one-half of the size of the volume to be dispensed to cup 18 has been dispensed.

Figure 3:
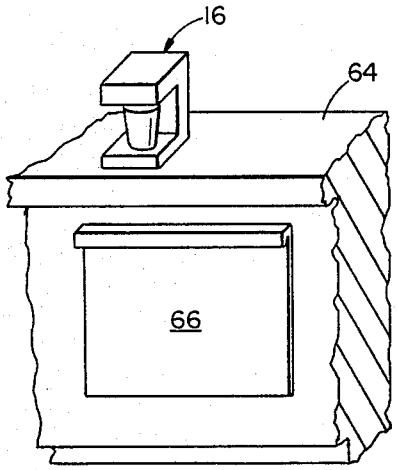
FIG. 3 is a diagrammatic perspective view showing a dispenser of the FIG. 1 apparatus on the top of a counter having a door to a refrigerated compartment under it.
Figure 4:
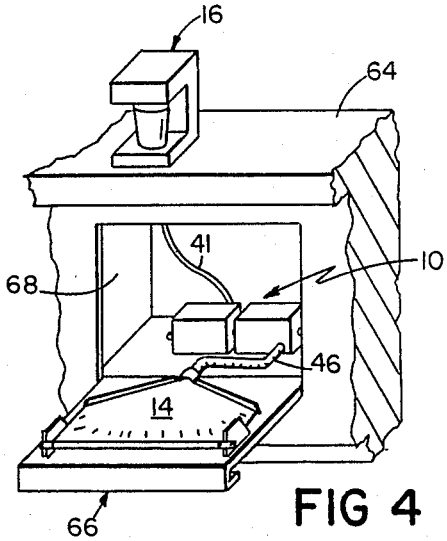
FIG. 4 is a diagrammatic perspective view of the FIG. 3 counter with the door in an open position and exposing components of the FIG. 1 apparatus.

Referring to FIGS. 3 and 4, beverage dispenser 16 is shown mounted on the top of counter 64. Underneath counter 64 is door 66 to refrigerated compartment 68 in which the rest of apparatus 10 is maintained in a refrigerated condition.

Figure 5:
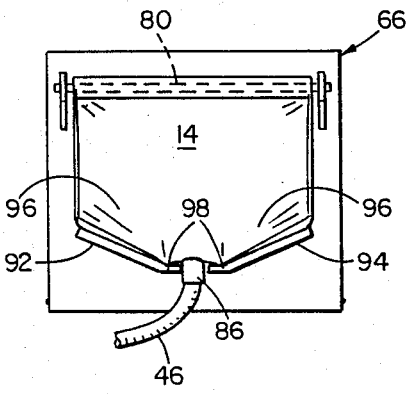
FIG. 5 is an elevation showing a concentrate bag of the FIG. 1 apparatus suspended by a support structure in an operational position.
Figure 12:
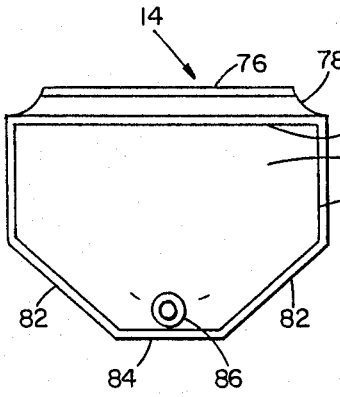
FIG. 12 is a front elevation of a concentrate bag according to the invention.
Figure 13:
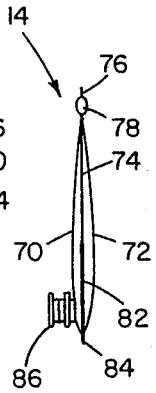
FIG. 13 is a side elevation of the FIG. 12 concentrate bag.
Figure 13A:
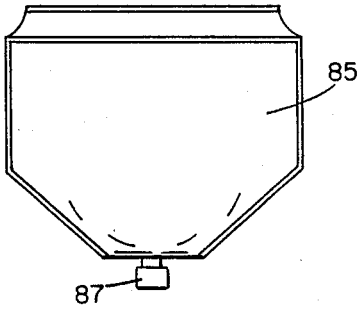
FIG. 13A is a front elevation of an alternative concentrate bag.
Figure 13B:
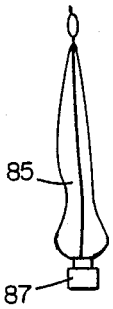
FIG. 13B is a side elevation of the FIG. 13A concentrate bag.

Referring to FIGS. 12, 13, concentrate bag 14 is made of front and rear sheets of plastic 70, 72 sealed together by peripheral seals 74. Two horizontal seals 76 define a tunnel 78 between them for receiving a horizontal supporting rod 80 (FIG. 5). The bottom of bag 14 has sloping side portions 82, sloping at an angle of approximately 30 degrees to center drainage portion 84 and outflow fitting 86, to assist in drainage of concentrate from bag 14. Concentrate bag 14 is approximately 11 inches high and 18 inches wide. Referring to FIGS. 13A, 13B, alternative concentrate bag 85 is made of a single sheet of plastic, folded at the bottom of the bag except at a central portion to which fitting 87 is attached in a downward directed orientation.

Referring to FIG. 5, concentrate bag 14 is supported by horizontal support rod 80 through tunnel 78. The two ends of rod 80 are received in angled grooves 88 of support brackets 90 extending from the back of refrigerator door 66. The ends of rod 80 have notches sized to fit within slots 88 and to restrain horizontal movement of rod 80 along its longitudinal axis. Slots 88 make a 30 degree angle with the vertical when in position of FIG. 6 and a 30 degree angle with the horizontal when in the horizontal loading position of FIG. 7, so that the slots are always directed upward and prevent rod 80 from rolling out of slots 88. Bottom supports 92, 94 are used to support the bottom of bag 14. They include sloping portions 96, sloping at an angle of about 15 degrees, and horizontal portions 98 near the center that are spaced from each other by a region permitting fitting 86 to be directed downward to supply tube 46.

Referring to FIGS. 8 through 11, there is shown alternative concentrate bag support structure 98 for use in a refrigerated compartment in which the refrigerator doors (not shown) rotate open about a vertical axis. Support structure 98 includes base member 100, for mounting on the floor of the refrigerated compartment, and rotating support member 102 rotatably mounted to base 100 at pivots 104. Support member 102 includes two side walls 106 having angled support tube slots 108 that are directed upward in both the operational position of FIG. 10 and the loading position of FIG. 11, functioning similarly to slots 88 of the FIGS. 5–7 support structure. Support member 102 also includes flat back 110, used to support a concentrate bag when in the loading position of FIG. 11, and a gripping member 112. Base 100 also includes vertical wall 114. Pivot 104 is located with respect to front bottom corner 116 to limit forward rotation of member 106 to the position shown in FIG. 10, at which back 110 makes about a 15 degree angle with the vertical. This 15° angle is provided for the operational position to prevent support member 102 from accidentally rotating outward (clockwise in FIG. 10) when loaded with a bag; the angle could be more (e.g., even up to 45°, though this would result in wasted space), and alternatively a locking mechanism could be used, though this would somewhat complicate the bag replacement procedure.

Referring to FIGS. 14, 14A, and 15, there is shown two-piece fitting 118. First piece 86 is adhered (e.g., by adhesive or heat or other sealing) to the wall of plastic bag 14 at annular sealing surface 120 surrounding an entrance to flow passage 122 through tubular member 123, having external helical threads 124 at discharge end 126. Second piece 127 includes flow tube 128, having sharp piercing end 130 with openings 132 to the flow passage within tube 128, and cap 134, having internal helical threads 136 therein for mating with threads 124. Flow tube 128 includes lower end 138 for connection to supply line 46 to permit flow of concentrate in bag 14 through supply opening 140. Flow tube 128 also has external annular tube lip 142, for bearing against and sealing with the lower annular surface of discharge end 126 of piece 86, and annular retaining lip 144, for retaining lower annular cap tube lip 146 between it and lip 142. In FIG. 15 pieces 86 and 127 are shown connected together with piercing end 130 extending through the wall of bag 14 and communicating with the interior of bag 14. The outer surface of flow tube 128 makes a snug fit with the inner surface defining flow passage 122 of piece 86. Cap 134 includes radially extending tabs 148 to assist in rotating cap 134.

Figure 16:
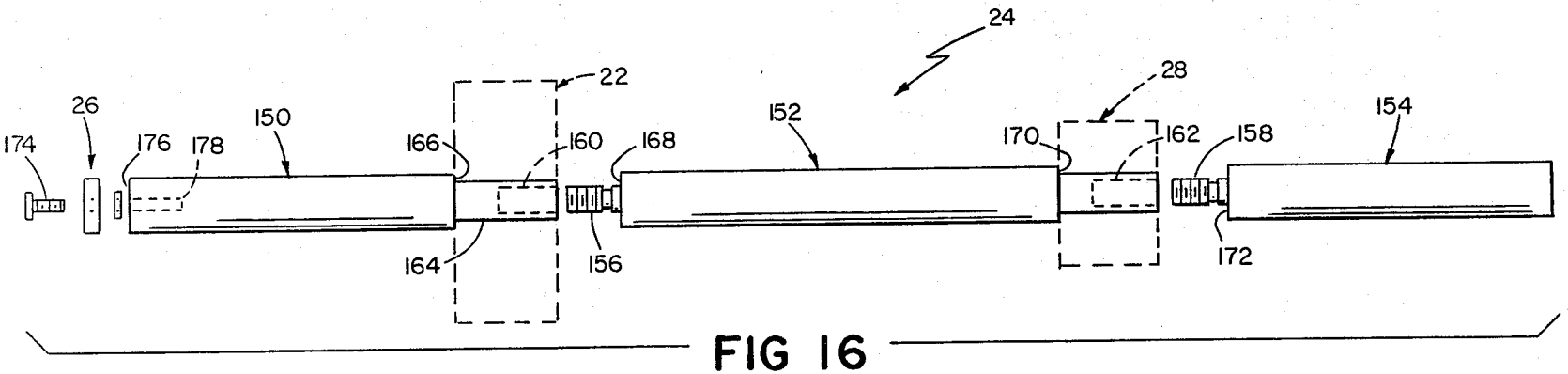
FIG. 16 is an exploded elevation of a three-piece piston rod of the FIG. 1 apparatus.

Referring to FIG. 16, it is seen that piston rod 24 has three pieces 150, 152, 154, threadedly connected together by male threads 156, 158 on pieces 152, 154, respectively, and mating female threads 160, 162, on pieces 150, 152, respectively. Rods 150, 152 have reduced diameter ends 164, 166 for receiving driving piston 22, and driven piston 28, respectively. When the three piston rods are connected together, piston 22 is tightly engaged between radial circumferential surface 166 on piece 150 and opposing radial circumferential surface 168 on piece 152. Piston 28 is similarly tightly engaged between radial circumferential surface 170 on piece 152 and radial circumferential surface 172 on piece 154. Magnet 26 is ¼ inch thick and ⅛ inch in diameter and as has a ⅛ inch inner diameter hole for receiving screw 174 through it. Between magnet 26 and the end of piece 150 is spacer 176 to provide the proper position of magnet 26 with respect to piston 22. Screw 174 is screwed into threaded recess 178 of rod 50 and held in place with cement.

Figure 18:
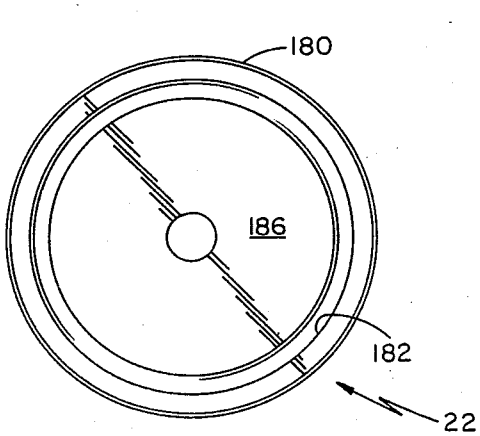
FIG. 18 is a side elevation of the FIG. 17 piston.
Figure 17:
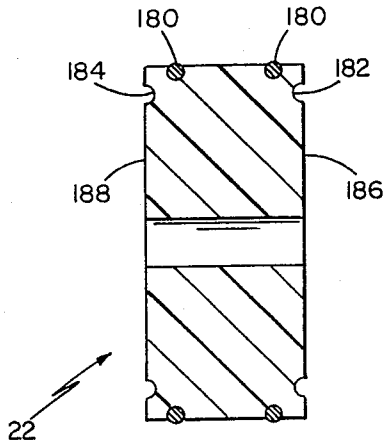
FIG. 17 is a vertical sectional view of a piston of the FIG. 1 apparatus.

Referring to FIGS. 17 and 18, it is seen that driving water piston 22 has rubber O-rings 180 for sealing with the inner surface of chamber 34 of water cylinder 20, and annular grooves 182, 184 in its faces 186, 188 at positions aligned with water inlet ports 42, 44 of cylinder 20. The purpose of grooves 182, 184 is to symmetrically distribute pressurized water being provided to chamber 34 during the beginning of a stroke. Grooves 182, 184 could just as easily be provided in the surfaces of the end walls of chamber 38.

Figure 19:
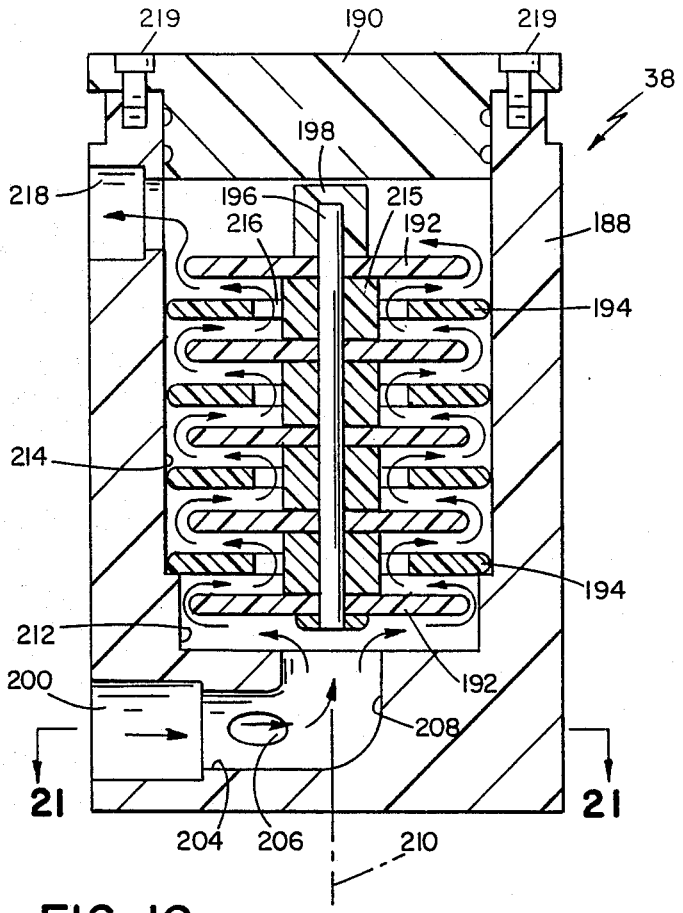
FIG. 19 is a vertical sectional view of a mixing chamber used in the FIG. 1 apparatus.
Figure 20:
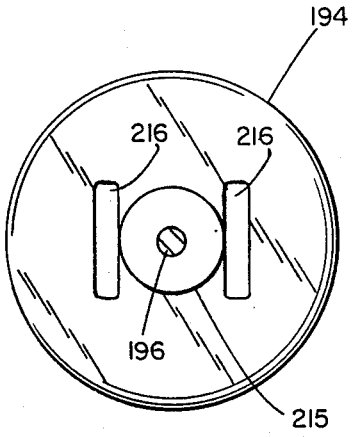
FIG. 20 is a plan view of a flow restriction plate of the FIG. 19 mixing chamber.
Figure 21:
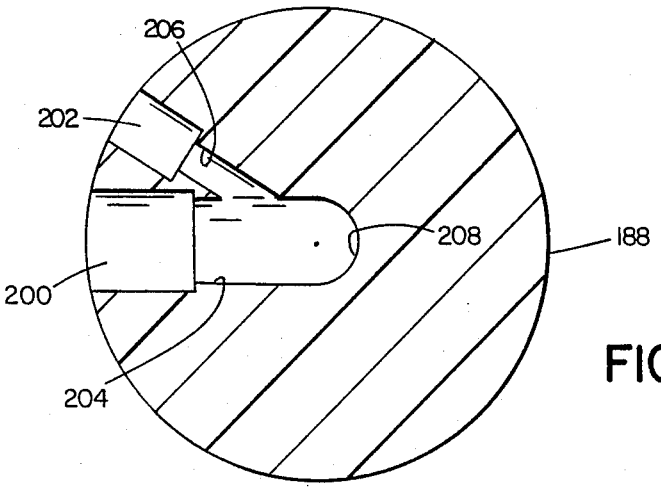
FIG. 21 is a horizontal sectional view, taken at 21—21 of FIG. 19, of the FIG. 19 mixing chamber.

Referring to FIGS. 19–21, there is shown mixing chamber 38, including housing 188, cap 190 and a stack of alternating diverter plates 192 and flow restriction plates 194 mounted on shaft 196 passing through the centers of plates 192, 194 and secured to stem 198. Housing 188 has water inlet 200 and concentrate inlet 202 formed in its lower portion. Inlet 200 communicates with a 9/16" diameter flow passage 204, and concentrate inlet 202 communicates with a 0.25" diameter passage 206. Both passages 204, 206 are directed to the center of vertical 9/16" diameter flow passage 208 about vertical center axis 210. Flow passage 208 ends at initial chamber 212, having a 1.40" diameter. The axes of passages 204 and 206 make a 35° angle with each other. The cross-sectional area of passage 204 is approximately five times the cross-sectional area of passage 206, so that both the water and concentrate have approximately the same velocity when they meet, to avoid pressure differences and resulting inhibition of flow.

Above initial chamber 212 in housing 188 is 1.600±0.002" diameter chamber 214. The lowest diverter plate 192 sits within initial chamber 212. The lowest flow restriction plate 194 sits on the ledge at the bottom of chamber 214. Four flow restriction plates 194 and four diverter plates 192 are located in chamber 214. Diverter plates 192 have a 1.250" outer diameter providing room for flow of liquid around their entire peripheries. Flow restriction plates 194 have a 1.595" outer diameter, providing for extremely limited, if any, flow around or between their peripheries and the inside of chamber 214. Flow restriction plates 194 also have 0.100" high, 0.375" diameter spacer portions 215 extending from both sides and elongated flow passages 216 through them providing restricted flow from below a plate 194 to above a plate 194. Passages 216 are located symmetrically about axis 210, their longitudinal axes being perpendicular to a horizontal radial axis through plate 194, and spaced from axis 210 by 0.260" at the point of intersection. Passages 216 are each 0.500" long and ⅛" wide.

At the top of chamber 214 is outlet 218. Mixing chamber 40 is identical to mixing chamber 38 except that the entire flow into it is through a single inlet similar to inlet 200, and there is no inlet or passage corresponding to inlet 202 and passage 206. Cap 190 is removably secured to housing 188 by screws 219.

Figure 22:
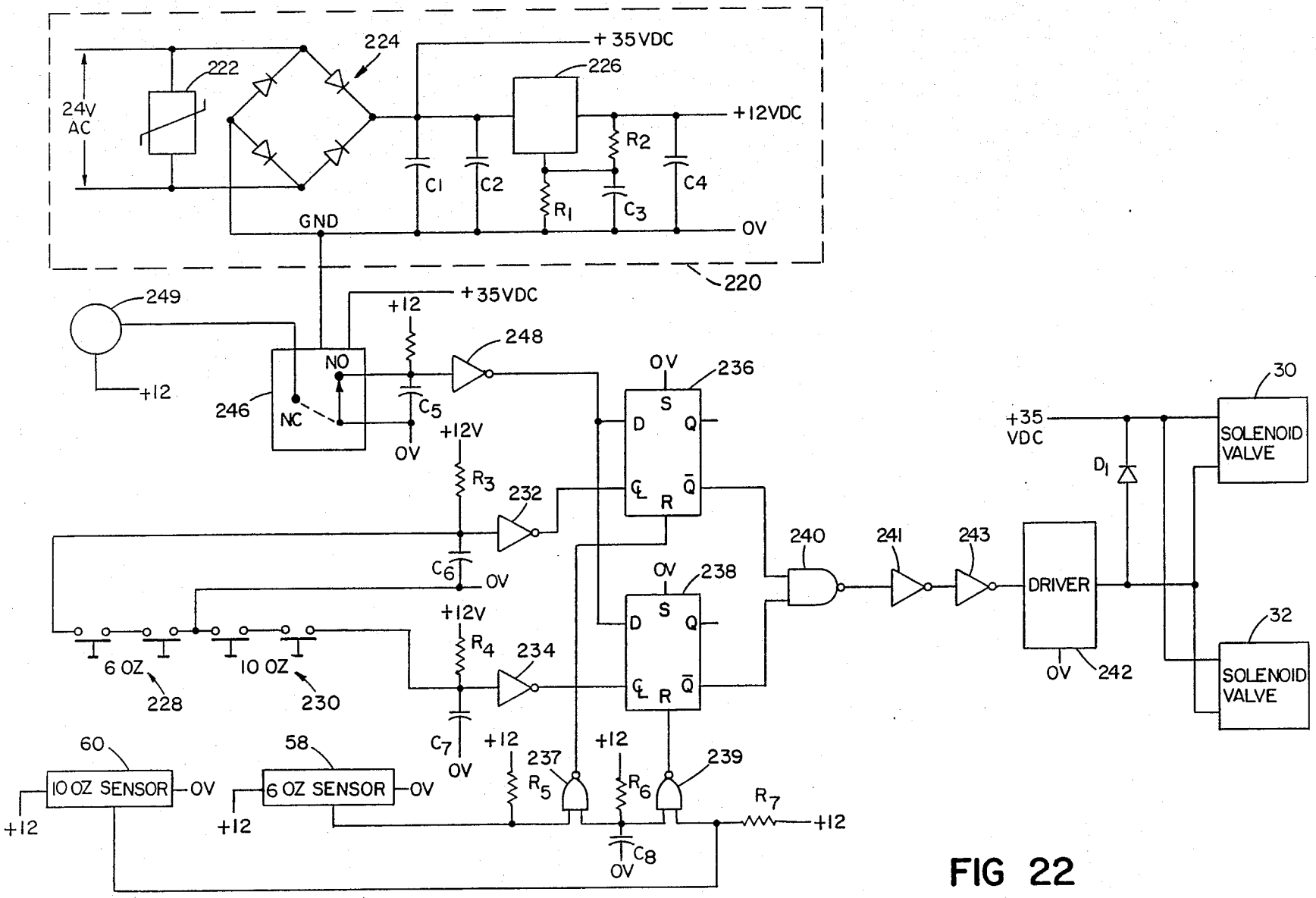
FIG. 22 is an electrical schematic of control circuitry for the FIG. 1 apparatus.

Referring to FIG. 22, there is shown the electrical schematic for the control circuitry of the FIG. 1 apparatus. Power supply 220 is used to convert 24 volts AC, available at most commercial eating establishments, to the 35 volts DC and the 12 volts DC used by the components. Power supply 220 includes varistor 222 (V47MA2B), rectifying diode bridge 224 (four 2 amp, 100 volt diodes, 3N254), and regulator 226 (LM217LH).

Six-ounce activation switch 228 and ten-ounce activation switches 230 are located in dispenser 16 (FIG. 1) and are activated by the rim of a six-ounce or a ten-ounce cup 18, respectively. They are connected through respective inverters 232, 234 to the clock inputs of respective six-ounce and ten-ounce flip-flops 236, 238 (CD4013BC), the reset inputs of which flip-flops are connected through respective NAND gates 237, 239 to hall effect sensors 58, 60 (SS81CA). The complement outputs of flip-flops 236, 238 are connected through NAND gate 240 and inverters 241, 243, acting as a buffer, to driver 242 (IRF530), controlling solenoid valves 30, 32.

Optical detector 246 is connected via inverter 248 to the D inputs to flip-flops 236, 238, so that when optical detector 246 detects the existence of concentrate, its diagrammatically indicated switch will be in the position indicated in solid, so that there will be a low signal provided to the D input to flip-flops 236, 238, permitting a driving voltage to be applied to the solenoids upon the activation of the six-ounce switches 228 or the ten-ounce switches 230. When optical detector 246 senses the absence of concentrate, as indicated by the dashed line switch position, indicator light 249 is lit, and a high signal is provided at the D inputs to flip-flops 236, 238, preventing solenoid valves 30, 32 from being activated. Optical detector 246 could include fiber optics (to transmit light to and from the sensing area), or employ LED's as a source; alternatively, other empty bag sensors such as weight sensing microswitches could be used. The capacitors, resistors, and other components are as in the following table.

TABLE

| | |
|---|---|
| Capacitors | |
| $C_2$, $C_5$, $C_6$, $C_7$ | 0.1 uf |
| $C_4$ | 1 uf |
| $C_3$, $C_8$ | 10 uf |
| $C_1$ | 100 uf |
| Resistors | |
| $R_1$ | 240 |
| $R_2$ | 2200 |
| $R_3$, $R_6$, $R_5$, $R_6$, $R_7$ | 10K |
| diode $D_1$ | 1N4532 |
| inverters | CD4009C |
| NAND gates | CD4011C |

Operation

Referring to FIG. 1, an operator initiates filling of cup 18 with orange juice by raising cup 18 so as to contact either switches 228 or 230. Taking first the case when cup 18 is a six-ounce cup, its rim contacts both switches 228, causing pistons 22, 28 to each travel through a single forward stroke and a single backward stroke and fill the six-ounce cup with orange juice.

Referring to FIG. 22, the closing of both switches 228 causes the input to inverter 232 to go low, causing its output provided to the clock input of six-ounce flip-flop 236 to go high, providing a low output at the complement output of flip-flop 236, in turn causing (via a change in outputs of NAND gate 240 and inverters 241, 243) driver 242 to activate solenoid valves 30, 32.

The application of the driving voltages to solenoid valves 30, 32 causes them to move from their at-rest positions of FIG. 1 to their activated positions shown in FIG. 2. This causes water under pressure to be directed from line 12 through valve 32 (FIG. 2) and ports 44 to the right side of water piston 22, causing piston 22 to be moved to the left. Water at Ports 44 communicates with the water in annular groove 182 (FIGS. 17, 18), evenly providing increased pressure around Piston 22, assisting in initial movement of piston 22 without any uneven forces or tilting of piston 22.

As piston 22 is moved to the left by water under pressure at its right side, the water to the left of piston 22 in chamber 34 is forced out of ports 42 through solenoid valve 30 (FIG. 2) and through supply line 36 to first mixing chamber 38. At the same time piston 28 is caused to move to the left with piston 22 and piston rod 24, causing concentrate on the left side of piston 28 to flow through the left-side one-way valve 54 through supply line 56 to chamber 38. At the same time concentrate is pulled into chamber 52 at the right side of piston 28 through one-way valve 50 at the right side. The use of gravity controlled one-way valves reduces the likelihood of clogging. The gravity control one-way valves can be sealed even with pulp between the closure member and the seat; during the next cycle when flow goes through them, the pulp will be easily flushed through. The surface area of piston 22 is five times that of concentrate piston 28, resulting in five times as much water being supplied to mixing chamber 39 as concentrate, providing for mixing in the desired proportions.

Referring to FIGS. 19 through 21, mixing chambers 38, 40 provide for very good mixing of the orange juice concentrate with water. Water enters through passage 204 and concentrate enters through passage 206 and combines with the water in passage 204, the velocities of these liquids through passages 204 and 206 being approximately equal, owing to the flow areas being in the same ratio as the flow rates. The combined stream of water and orange juice concentrate flows upward along axis 210 into chamber 212, where it is deflected radially outward by the lowest deflector plate 192. The flow goes around the end of plate 192 and heads in a generally radially inward direction to elongated flow restriction passages 216 in the first flow restriction plate 194. At restricted passages 216, the combined flow is caused to travel at a very high velocity and impinge against the surface of the next deflector plate, which causes the combined stream to travel generally radially outward around the next deflector plate, and so on upward through and past the following plates. Flow passage 216 has a small width, to provide a small cross-sectional area flow passage to provide increased velocity to help in agitation, and is elongated to assist in the passage of fibrous orange juice pulp without clogging. Two flow restriction passages 216 are provided symmetrically on plates 194 to provide even flow conditions on both sides of axis 210. The repeated subjecting of the combined stream of water and concentrate to the increased velocity and the abrupt change in direction provides for good mixing of the two. With the very hard to mix five to one concentrate, two chambers 39, 40 are required to provide the desired mixing. With three to one concentrate, a single mixing chamber 38 could be used, though it would preferably have a slightly enlarged concentrate passage 206, or a slightly smaller water flow passage 204, to provide matched velocities.

The forward strokes of pistons 22, 28 end when magnet 26 at the end of piston rod 24 travels toward and into the vicinity of six-ounce magnetic position sensor 58, the increase in magnetic field at sensor 58 causing a related change in the voltage output of sensor 58 (FIG. 22). Magnet 26 is thin and has a defined magnetic field which very repeatedly and accurately is sensed by the magnetic position sensors. When the output voltage passes the threshold for NAND gate 237, the output of NAND gate 237 changes and resets flip-flop 236, removing the driving voltages provided by driver 242 to solenoid valves 30, 32. Solenoid valves 30, 32 then return to the at-rest positions shown in FIG. 1, causing water under pressure to be directed to the left side of piston 22 and water on the right side of piston 22 to be pumped through line 36 to first mixing chamber 38. At the same time piston rod 24 and concentrate piston 28 move to the right, with orange juice concentrate being forced through right-side one-way valve 54 through supply line 56 to first mixing chamber 38. At the same time concentrate is pulled in through supply line 46, passage 48 and left-side one-way valve 50 into chamber 52 at the left side of piston 28. When pistons 22, 28 simultaneously reach the right-hand ends of chambers 34, 52, respectively, they stop, and flow of water and concentrate to mixing chambers 38, 40 and the flow of reconstituted orange juice into cup 18 similarly stop.

Because magnetic position sensor 58 very accurately senses the position of the pistons, the desired volume is very accurately supplied to cup 18. If the power supply to the device is interrupted at any point after a fill has been initiated, the power to solenoids 30, 32 is removed and the pistons automatically return to the at rest position shown in FIG. 1, though less than the desired volume will be provided if power is lost before the end of the forward stroke.

With five to one concentrate, the two mixing chambers provide maximum stratification of 0.6 brix from top to bottom. With three to one concentrate, a single mixing chamber provides maximum stratification from top to bottom of only 0.1 brix. Both results exceed the industry standard of maximum brix variation of 1.0 brix from top to bottom of a finished dispensed drink.

Considering now the case of filling a ten-ounce cup 18, when its rim contacts switches 230 and causes them to close (FIG. 22), the input to inverter 234 goes low, and its output provided to clock input of the ten-ounce flip-flop 238 goes high, again initiating a fill operation by providing driving voltages to solenoid valves 30, 32. This time as the magnet 26 passes magnet position sensor 58, the reset signal provided by NAND gate 237 does not affect operation, as flip-flop 236 is already in the reset position. When magnet 26 travels toward and into the vicinity of sensor 60, the increase in the magnetic field and related change in the output voltage passes the threshold for NAND gate 239; its output changes and resets flip-flop 238, in turn turning off driver 242, and removing the driving voltages from solenoid valves 30, 32, causing them to return to their FIG. 1 positions, and piston 22 and piston 28 to automatically begin their return strokes. The ten-ounce return stroke begins with piston 22 close to or against the left side of chamber 34. Water entering ports 42 at the beginning of the return stroke is evenly distributed through groove 184 (FIGS. 17–18) to balance forces on piston 22 in its initial movement away from the end of cylinder 20.

At any time during operation, if optical sensor 246 indicates that concentrate bag 14 is out of concentrate, the dashed line position of its switch shown in FIG. 22 causes inverter 248 to go high, and the complement outputs of flip-flops 236, 238 to be low, preventing the providing of driving voltages to solenoid valves 30, 32. It also causes a indicator light 249 to light up, indicating to the operator that bag 14 is empty and needs to be replaced with a new bag.

Referring to FIGS. 3 through 7, assuming that empty bag indicator light 249 has lit up, and apparatus 10 has been inactivated, the operator opens door 66 to the position shown in FIG. 4, disconnects supply line 46 from empty bag 14, lifts support rod 80 and the empty bag 14 and removes support rod 80 from the empty bag 14. The operator then lays a new full bag 14, which is slippery, deformable, and quite unmanageable, on door 66 in the position shown in FIG. 7 to support the bag. With the bag supported on door 66, the operator can easily slide support rod 80 into tunnel 78 and put rod 80 back into slots 88 of brackets 90. While in the loading position, rod 80 does not roll out of slots 88, as they are directed upward.

The operator also connects supply line 46 to the new bag 14 by, referring to FIGS. 14, 14A, 15, screwing cap 134 provided on supply line 46 onto fitting 86, provided on the bottom of new bag 14. As cap 134 is screwed to the position shown in FIG. 15, piercing end 130 moves axially through the flow passage 122, pierces the wall of bag 14, and communicates with the concentrate on the inside of bag 14. Because pieces 127, 86 of two-piece fitting 118 are substantially connected together at the time of piercing, and flow is directed through openings 132 into the flow passage of tube 128, spillage of concentrate is avoided during the changeover process.

Figure 6:
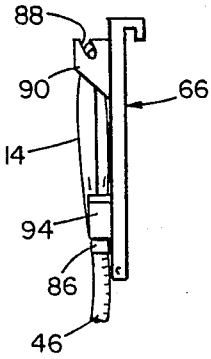
FIG. 6 is a side elevation of the FIG. 5 bag and support structure in an operational position.

With the bag of the type shown in FIGS. 12 and 13, fitting 86 extends out from a side wall of the bag, and it thus must be directed through the opening between support plates 92, 94 as shown in FIGS. 5, 6. With the bag of the type shown in FIGS. 13A, 13B, fitting 87 is naturally in the proper orientation.

Figure 7:
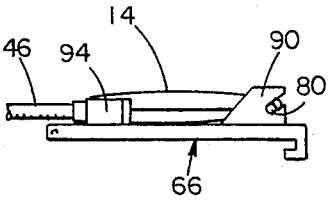
FIG. 7 is a side elevation of the FIG. 5 bag and support structure in a loading position.
Figure 8:
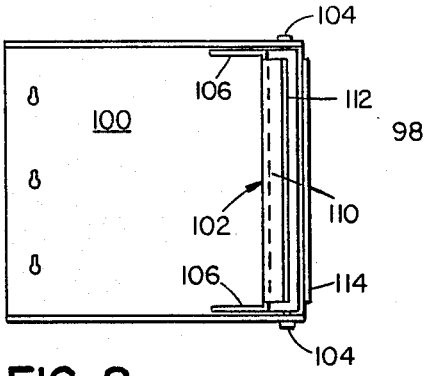
FIG. 8 is a plan view of an alternative concentrate bag support structure.
Figure 9:
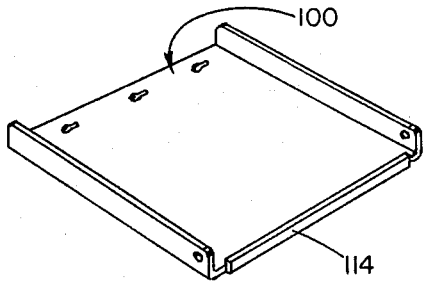
FIG. 9 is a diagrammatic perspective view of a base member of the FIG. 8 support structure.
Figure 10:
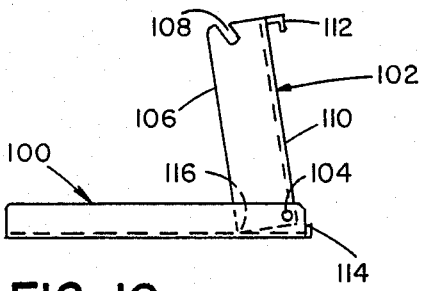
FIG. 10 is an elevation of the FIG. 8 support structure in an operational position.
Figure 11:
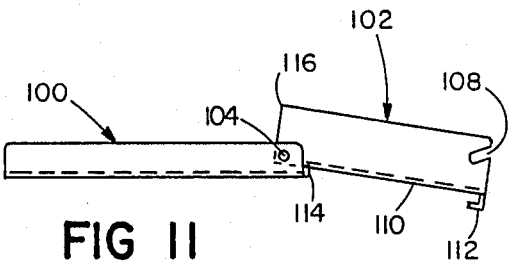
FIG. 11 is a side elevation of the FIG. 8 support structure in a loading position.

With a new bag 14 properly installed and connected, the operator then rotates door 66 back from the loading position shown in FIGS. 4, 7 to the closed, operational Position shown in FIGS. 3, 5, 6, causing the bag to be suspended by support rod 80 and brackets 90, providing gravity assisted drainage of concentrate. As the concentrate in bag 14 is removed, sloped bottoms 82 of bag 14 and supporting surfaces 96 facilitate good drainage of virtually all of the concentrate from bag 14. Supports 92, 94 also facilitate the collapsing of bag 14 as most of the concentrate is removed from the bag.

If the refrigerated compartment has a door that pivots about a vertical axis, and support structure 98 shown in FIGS. 8 through 11 is used, the changing of one concentrate bag for another is the same. With apparatus 98 in the operational position shown in FIG. 10, support member 106 is leaning forward slightly, preventing it from tipping backward and open.

Periodically, for example once a week, the mixing chambers can be disassembled and cleaned. Cap 190 can be easily pulled off, and the stack of plates 192, 194 removed, to facilitate cleaning.

If it is desired to change apparatus 10 for use with a different strength concentrate, for example three to one concentrate, one of the pistons and its associated cylinder can be easily replaced with a piston and cylinder of a different diameter. Disassembly and replacement of the cylinder and the piston are facilitated by the easily disconnecting, threaded structure of three-piece piston rod 24.

Other Embodiments

Other embodiments of the invention are within the scope of the following claims.

What is claimed is:

1. Apparatus for mixing liquids containing fibrous pulp comprising a housing defining an inlet and outlet and a flow path therethrough, a plurality of restriction plates provided along said flow path to repeatedly provide increased velocity to said liquid, and a plurality of flow diverters after respective said restriction plates to divert the flow of liquid directed to them at increased velocity from said restriction plates, said plurality of restriction plates having flow apertures through them through which said liquid flows, all said flow apertures being elongated flow apertures, said elongated flow apertures having flow passages elongated along restriction axes transverse to the direction of flow through them, said apertures being sufficiently long to pass fibrous pulp in said liquid without clogging, said apertures being sufficiently narrow to provide restricted overall flow area, the flow diverters being diverter plates comprising stationary, unapertured plates.

2. The apparatus of claim 1 wherein said diverter plates are positioned between said restriction plates so that said liquid leaving one said restriction plate is caused to travel along one surface of one said diverter plate to the edge of said one diverter plate and to reverse direction and along the other surfaces to the next said restriction flow.

3. The apparatus of claim 1 wherein said housing includes a removable cover, permitting access to said plates.

4. The apparatus of claim 1 wherein said plates are connected together for easy removal from said housing.

5. The apparatus of claim 1 wherein alternate said plates are said restriction plates and alternate said plates are said diverter plates.

6. The apparatus of claim 5 wherein said diverter plates have edges that are spaced inward from an inner surface of said housing, and said restriction plates extend to said inner surface.

7. The apparatus of claim 6 further comprising spacers between said plates.

8. The apparatus of claim 7 wherein said housing is cylindrical, said plates are circular, and said spacers are provided along the central axis of said housing.

9. The apparatus of claim 8 wherein said elongated flow apertures are symmetrically positioned with respect to said axis.

10. The apparatus of claim 1 wherein said elongated flow passages are approximately $\frac{1}{8}''$ wide.

11. A method of reconstituting fruit juice including fibrous pulp, said method comprising adding water to juice concentrate including fibrous pulp to form a combined stream, and repeatedly subjecting said combined stream to restriction plates providing an increased velocity and flow diverters following the restriction plates diverting liquid subjected to them at increased velocity by said flow restrictions, said restriction plates having flow apertures through which said liquid flows, all said flow apertures being elongated flow apertures, said elongated flow apertures having elongated flow passages that are elongated along restriction axes transverse to the direction of flow through them, said elongated flow apertures being sufficiently long to pass said fibrous pulp in said liquid without clogging, said apertures being sufficiently narrow to provide restricted overall flow area, the flow diverters comprising stationary, unapertured plates, the method further including passing the stream through the elongated aperture and around the flow diverters.

12. The method of claim 11 wherein said diverter plates are positioned between said restriction plates so that said liquid leaving one said restriction plate is caused to travel along one surface of one said diverter plate to the edge of said one diverter plate and to reverse direction and flow along the other surface to the next said flow restriction plate.

13. The method of claim 12 wherein alternate said plates are said restriction plates and alternate said plates are said diverter plates.

14. The method of claim 13 wherein said elongated flow apertures are symmetrically positioned with respect to said axis on each said restriction plate.

15. The method of claim 14 wherein said elongated flow passages are approximately $\frac{1}{8}''$ wide.

* * * * *

UNITED STATES PATENT AND TRADEMARK OFFICE

CERTIFICATE OF CORRECTION

PATENT NO. : 4,854,721

DATED : August 8, 1989

INVENTOR(S) : Ronald W. Hume

It is certified that error appears in the above-identified patent and that said Letters Patent is hereby corrected as shown below:

col. 9, line 68, "Piston" should be --piston--, col. 12, line 35, "Position" should be --position--, col. 13, line 1, insert --an-- before "outlet", col. 13, line 25, insert --flow-- before "along", col. 13, line 25, "surfaces" should be --surface--, col. 13, line 26, "flow" should be --plate--, col. 13, line 28, delete "," after "cover", col. 13, line 30, "1" should be --3--, col. 13, line 37, delete "," after "housing", col. 14, line 14, "flow restrictions" should be --restriction plates--, col. 14, line 26, "aperture" should be --apertures--,

UNITED STATES PATENT AND TRADEMARK OFFICE

CERTIFICATE OF CORRECTION

PATENT NO. : 4,854,721

DATED : August 8, 1989

INVENTOR(S) : Ronald W. Hume

It is certified that error appears in the above-identified patent and that said Letters Patent is hereby corrected as shown below:

col. 14, line 34, delete "flow".

Signed and Sealed this

Sixteenth Day of October, 1990

*Attest:*

HARRY F. MANBECK, JR.

*Attesting Officer*

*Commissioner of Patents and Trademarks*